United States Patent [19]

Uchiyama

[11] 3,939,646

[45] Feb. 24, 1976

[54] WATER TIGHT WATCH CASE USING AN INORGANIC GLASS CRYSTAL

[75] Inventor: Hideaki Uchiyama, Suwa, Japan

[73] Assignee: Kabushiki Kaisha Suwa Seikosha, Tokyo, Japan

[22] Filed: May 17, 1974

[21] Appl. No.: 471,053

[30] Foreign Application Priority Data

May 21, 1973 Japan ..... 48-59681

[52] U.S. Cl. ..... 58/90 R

[51] Int. Cl.[2] ..... G04B 37/08

[58] Field of Search ..... 58/90 R, 91

[56] References Cited

UNITED STATES PATENTS

| | | | |
|---|---|---|---|
| 3,052,083 | 9/1962 | Piquerez | 58/90 R X |
| 3,261,159 | 7/1966 | Simon et al. | 58/90 R |

*Primary Examiner*—George H. Miller, Jr.

*Attorney, Agent, or Firm*—Haseltine, Lake & Waters

[57] ABSTRACT

A water-tight watch case having an inorganic glass crystal to which a layer of transparent or semi-transparent water-absorptive material is applied to a central region of the inner surface thereof to leave a bare peripheral region at which the crystal is hermetically sealed to the case.

8 Claims, 2 Drawing Figures

WATER TIGHT WATCH CASE USING AN INORGANIC GLASS CRYSTAL

BACKGROUND

1. Field of the Invention

This invention relates to a water-tight watch case using an inorganic glass crystal and particularly to a construction for preventing fogging of the crystal due to vapor formation inside the case when it is used under severe conditions.

2. Prior Art

In a conventional water-tight case, its glass crystal sometimes becomes fogged with condensed vapor inside the case when the wristwatch is subjected to a sudden temperature change even if no external vapor permeates into the case. The reason for this is that some vapor is always included in the air and it is actually impossible to prevent some permeation of vapor into the case when it is in an atmosphere of high humidity.

In recent years, inorganic glass has become increasingly utilized as the crystal for timepieces. Such inorganic glass material has a larger thermal conductivity than conventional organic glass material such as acrylic resin. Therefore, if an inorganic glass crystal and an organic glass crystal are cooled under the same conditions, the former is more susceptible of fogging than the latter because the temperature becomes lower inside the former than inside the latter.

Although this fogging has no influence on the watch movement, it can cause apprehension to its user. Moreover, in the case of a divers' watch or the like, the fogging may cause a serious accident if it prevents the user from reading its time indication.

It is known to coat the entire inner surface of an inorganic glass crystal with a water-absorptive material to prevent condensed vapor from collecting and fogging the inner surface of the glass crystal. However, in the known construction, water can be absorbed by the water-absorptive material and gradually permeate into the case.

SUMMARY OF THE INVENTION

According to the invention, the water-absorptive material is applied only to a central region of the crystal and not to its periphery so that the crystal can be hermetically sealed to the case at said periphery.

DETAILED DESCRIPTION

Figure 1:
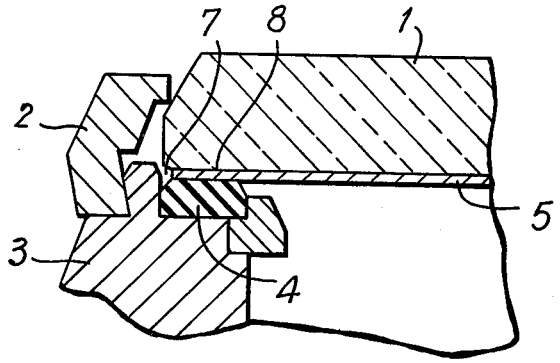
FIG. 1 PRIOR ART
FIG. 1 is a sectional view of a portion of a conventional water-tight watch case in which a conventional inorganic glass crystal is treated to be fog-resistant.

Referring to FIG. 1 in which a conventional construction is shown for a water-tight watch case, therein is seen a crystal 1 of inorganic glass material which is held in place by a bezel 2 on a band 3 of the case. An annular sealing gasket 4 is interposed between the band 3 and the crystal 1. In order to eliminate fogging of the crystal by condensation of vapor on the inner surface of the crystal 1, a layer 5 of water absorptive material is applied on the inner surface of the crystal.

However, a space 7 is formed at the periphery of the crystal 1 whereat water can be collected through the unsealed surfaces of the bezel, the band and the crystal. Such water will be absorbed by the water-absorptive material 5 and gradually permeate into the case. The outer peripheral portion of the water-absorptive material is always absorbing a considerable mass of water adversely affecting the fog-resistant ability of the coated crystal. Furthermore, when the water-absorptive layer 5 absorbs water, it tends to separate from the crystal thereby allowing water to permeate inside the case.

Thus the construction shown in FIG. 1 is deficient in many respects.

Figure 2:
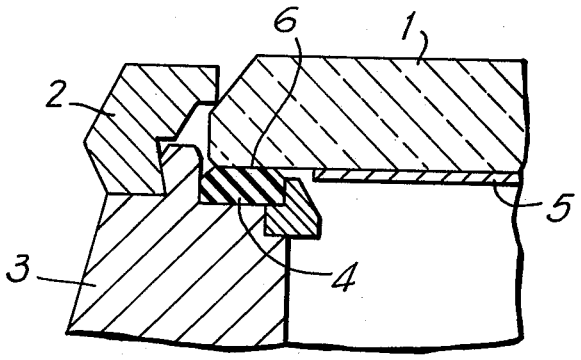
FIG. 2 is a similar view of a water-tight watch case in which the inorganic glass crystal is rendered fog-resistant according to the invention.

The construction according to the invention is intended to eliminate such deficiencies and in FIG. 2, there is seen the inorganic glass crystal secured by bezel 2 to case band 3 with water-tight gasket 4 compressed between crystal 1 and case band 3. The layer 5 of material which is transparent or semi-transparent has high water absorption is applied to the inner surface of the glass crystal 1 only in a central region thereof and is purposely omitted in its peripheral region to provide hermetic sealing at portion 6 of crystal 1 with the gasket 4. The material 5 can be an acrylic resin having an unsaturated OH group, or a cellulosic or epoxy coating having comparatively high water absorptivity. Its applied weight and water absorptivity satisfy the relation, $nW > 0.01$ milligrams, where W is the weight and $n$ is the coefficient of water absorptivity.

To apply the water-absorptive material to the inner surface of the glass crystal except for the peripheral region for sealing is difficult; especially in the case of a flat inner surface as shown in FIG. 2. However, this can be performed if the material 5 is applied only to the desired region of the crystal by covering the periphery outside said region with a tool or a particular resist agent. Although, as shown in FIG. 2, the annular sealing portion of the crystal is sealed by the gasket, it is also possible for the glass crystal and the metallic band 3 to be sealed with an adhesive agent in which case the water-absorptive layer 5 is not applied to the adhesively secured portion.

According to this invention, the sealed adherence between the layer 5 of water-absorptive material and the glass crystal is not rigorously required because the region of application of the water-absorptive material 5 is outside the region for effecting water-tightness.

As for the amount of the water-absorptive material which is necessary in the embodiment of FIG. 1, as the layer 5 absorbs the water in the space 7, its fog-resistant effect is not obtained unless it is applied in relatively large amount. However, a thick film on the inner surface of the glass crystal makes a uniform application thereof difficult, resulting in a tendency toward distortion of the appearance of the inner surface of the glass crystal. This is not preferable. On the contrary, according to the invention, the amount of water to be absorbed is only the amount of vapor which is inside the case. If it is only the amount of vapor inside the case which is taken into consideration, it is established that fogging can be detected in a worn watch case using an inorganic glass crystal when the amount of vapor inside the case reaches a level of 0.01~0.1 milligrams or more. Therefore, the amount of water-absorptive material which must be applied is that necessary to absorb this amount of vapor. Accordingly, the basic condition for the amount of water-absorptive material is $nW >$ 0.01 milligrams, where W is the amount of water-absorptive material by weight and $n$ is its coefficient of water-absorptivity. Thus, according to the invention the amount of water-absorptive material can be limited to relatively small quantities.

What is claimed is:

1. A water-tight watch case comprising an inorganic glass crystal, means hermetically sealing said crystal in a peripheral region thereof in the case, and a layer of water-absorptive resin having an unsaturated OH radical applied to said crystal at the inner surface thereof in a limited region to leave a bare peripheral zone at which the crystal is hermetically sealed, said means which hermetically seals the crystal in the case comprising a sealing element which bears against said crystal exclusively in said peripheral region where the layer of water-absorptive material is absent.

2. A water-tight watch case as claimed in claim 1 wherein said layer terminates at a relatively small distance from said sealing element.

3. A water-tight watch case as claimed in claim 1 wherein said limited region of application of said layer is a central region of said crystal constituting the major surface area thereof.

4. A water-tight watch case as claimed in claim 1 wherein said sealing element is an annular gasket.

5. A water-tight watch case as claimed in claim 4 wherein said layer of water-absorptive material extends over substantially the entire surface of said crystal, said peripheral zone being a narrow zone at which the gasket is directly positioned against the bare crystal, said layer extending to a position proximate the gasket but spaced a slight distance therefrom.

6. A water-tight watch case as claimed in claim 4 wherein said gasket is compressed against said crystal.

7. A water-tight watch case as claimed in claim 6 comprising means for compressing the crystal against the gasket.

8. A water-tight watch case as claimed in claim 7 wherein the compressing means comprises a bezel bearing against said crystal at the outer surface thereof.

* * * * *